United States Patent [19]

Cardieri

[11] 4,445,685

[45] May 1, 1984

[54] BATTING TEE

[76] Inventor: Edward J. Cardieri, P.O. Box 2393, St. Leo, Fla. 33574

[21] Appl. No.: 359,699

[22] Filed: Mar. 19, 1982

Related U.S. Application Data

[63] Continuation-in-part of Ser. No. 259,256, Apr. 30, 1981, Pat. No. 4,383,686.

[51] Int. Cl.[3] ..... A63B 69/40

[52] U.S. Cl. ..... 273/26 R; 403/104; 285/298

[58] Field of Search ..... 273/26 R, 26 A, 29 R, 273/202; 403/104; 285/302, 298

[56] References Cited

U.S. PATENT DOCUMENTS

| | | | |
|---|---|---|---|
| 1,242,046 | 10/1917 | Rogers | 273/202 |
| 1,929,579 | 10/1933 | Garlando | 273/202 |
| 2,079,387 | 5/1937 | Sickmiller | 273/202 |
| 3,039,770 | 6/1962 | Ferretti | 273/26 A |
| 3,139,282 | 6/1964 | Lande | 273/26 R |
| 3,489,411 | 1/1970 | Morelli et al. | 273/26 R |
| 4,194,735 | 3/1980 | Wilson | 273/26 R |
| 4,227,691 | 10/1980 | Lafeber et al. | 273/26 R |
| 4,258,944 | 3/1981 | Wendel | 285/298 |

*Primary Examiner*—Richard C. Pinkham

*Assistant Examiner*—T. Brown

*Attorney, Agent, or Firm*—Arthur W. Fisher, III

[57] ABSTRACT

A batting tee comprising a base including an upper and lower base member held in substantially parallel spaced relation relative to each other by a first set of spacers disposed therebetween wherein the upper and lower base member each comprises a first and second base element normally disposed in coplanar relation relative to each other, a second set of spacers attached to the lower surface of the lower base member to support the batting tee above the ground, a substantially vertical adjustable tee member including an outer interconnecting element having an upper and lower tee element extending from opposite ends thereof, a flexible ball receiving element is coupled to the upper portion of the upper tee element, a plurality of corresponding apertures comprising a predetermined pattern are formed in the upper and lower base members to selectively receive the lower tee element thereinto vary the ball hitting position relative to the batting tee wherein the predetermined pattern comprises at least two pair of substantially parallel rows of apertures to permit the batter to select one of at least three batting positions relative to the batting tee.

8 Claims, 5 Drawing Figures

BATTING TEE

COPENDING APPLICATIONS

This application is a continuation-in-part application to Ser. No. 259,256, filed Apr. 30, 1981 (U.S. Pat. No. 4,383,686).

BACKGROUND OF THE INVENTION

1. Field of the Invention

A batting tee comprising a base including a predetermined pattern of apertures formed therein and a substantially vertical adjustable tee member to permit the batter to select one of several batting positions relative to the batting tee.

2. Description of the Prior Art

In learning to hit a baseball the hitter must learn to coordinate the swing of the bat with the ball location. The hitter must be able to make contact with the ball at the various positions across home plate, from the inside pitch to an outside pitch, and from a high pitch to a low pitch, and various combinations of these two variables.

Various baseball tees for supporting a ball at selected heights have been developed so the batter can practice swinging to assist in improving hand-eye coordination.

Typically a batting tee includes a flat base with an elongated substantially vertical adjustable member, one end being connected to the base and the opposite end being configured to support a ball thereon.

Many such batting tees are not stable and lack versatility. In addition, the production for such batting tees are often expensive.

Moreover, such batting tees often cannot be readily disassembled or cannot be disassembled at all. This causes difficulty in packaging and shipping as well as storage problems.

The following are examples of prior art U.S. Pat. Nos.: 2,527,906; 2,976,041; 3,139,282; 3,489,411; 3,874,662; 3,883,138; 4,136,869 and 4,227,691.

SUMMARY OF THE INVENTION

The present invention relates to a batting or hitting tee comprising a base and an adjustable tee member.

The base comprises an upper and lower base member each including a first and second base element. The first and second base elements are held in substantially parallel spaced relation relative to each other by a first set of spacers. A second set of spacers extends downwardly from the lower base member to support the batting or hitting tee on the ground. A predetermined pattern of apertures are formed in the upper and lower base members comprising two pair of substantially parallel diagonal rows. This configuration permits a batter or hitter to hit inside, over the center and outside pitches from two positions on either side of the hitting tee by selectively placing the substantially vertical adjustable tee member.

The adjustable tee member comprises an elongated hollow interconnecting element having an upper and lower tee elements extending from opposite ends thereof. A substantially flexible ball support member including a beveled ball support element is coupled to the upper tee element. An adjustment means extends through the elongated hollow interconnecting element to engage the periphery of the upper tee element to lock the longitudinal or vertical position of the upper tee element relative to the elongated hollow interconnecting element.

The invention accordingly comprises the features of construction, combination of elements, and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
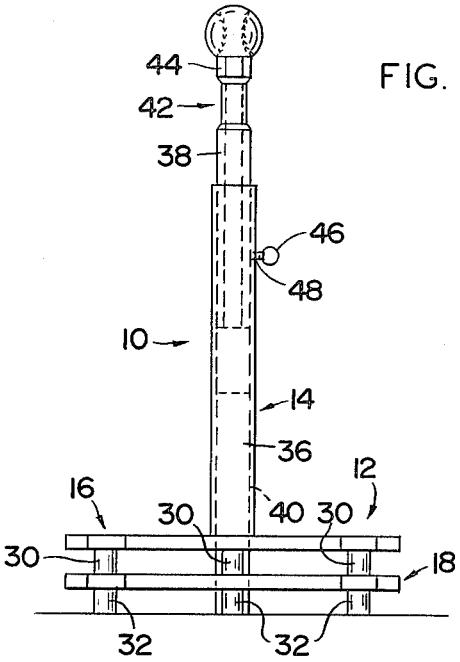
FIG. 1 is a front view of the batting tee.

As best shown in FIG. 1, the present invention relates to a batting or hitting tee generally indicated as 10 comprising a base and a substantially vertical adjustable tee member generally indicated as 12 and 14 respectively.

Figure 2:
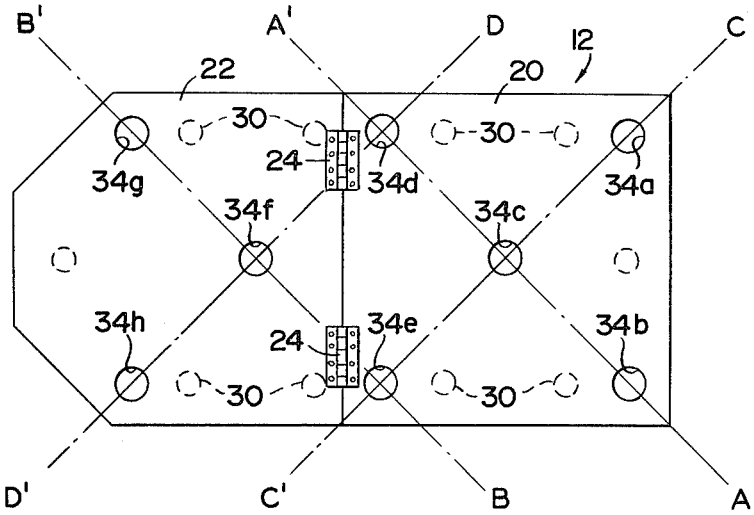
FIG. 2 is a top view of the batting tee.
Figure 3:
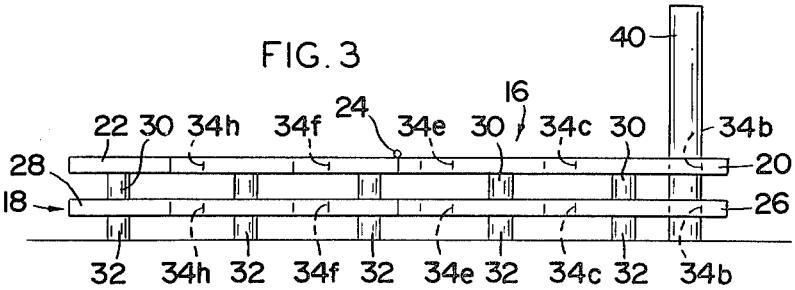
FIG. 3 is a side view of the batting tee.

As shown in FIGS. 1 through 4, the base 12 comprises an upper and lower base member generally indicated as 16 and 18 respectively. The upper base member 16 comprises a first and second base element 20 and 22 respectively hingedly coupled by hinges 24 while the lower base member 18 comprises a first and second base element 26 and 28 respectively. As best shown in FIG. 3, corresponding first and second base elements 20 and 22, and 26 and 28 respectively are substantially coplanar when the batting or hitting tee 10 is in use. The first base elements 20 and 26 ad well as second base elements 22 and 28 are held in substantially parallel spaced relation relative to each other by a first set of spacers each indicated as 30. A second set of spacers each indicated as 32 extends downwardly from the lower base member 18 to support the batting or hitting tee 10 on the ground. A predetermined pattern of apertures **34*a* through 34*h* are formed in the upper and lower base members 16 and 18. The predetermined pattern of apertures 34 comprises two pair of substantially parallel diagonal rows indicated as lines A through D. This configuration permits a batter or hitter to hit inside, over the center and outside pitches from two positions on either side of the hitting tee 10 indicated as A', B', C' and D' by selectively placing the substantially vertical adjustable tee member 14** as more fully described hereinafter.

As best shown in FIG. 1, the substantially vertical adjustable tee member 14 comprises an elongated hollow interconnecting element 36 having an upper and lower tee elements 38 and 40 respectively extending from opposite ends thereof. A substantially flexible ball support member 42 including a beveled ball support element 44 is coupled to the upper tee element 38. An adjustment means comprising a set bolt 46 extends through a threaded aperture 48 formed in the elongated hollow interconnecting element 36 to engage the periphery of the upper tee element 38 to lock the longitudinal or vertical position of the upper tee element 38 relative to the elongated hollow interconnecting element 36. The lower tee element 40 is fixedly secured to the lower portion of the elongated hollow interconnecting element 36.

Figure 5:
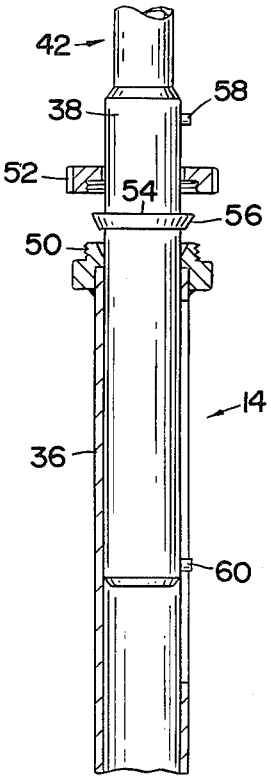
FIG. 5 is a front view of an alternate adjustable tee member.

As shown in FIG. 5 an alternate substantially vertical adjustable tee member 14 may comprise the elongated hollow interconnecting element 36 having the upper tee element 38 telescopingly disposed therein. The substantially flexible ball support member 42 as shown in FIG. 1 is similarly coupled to the upper portion of the upper tee element 38. The adjustment means comprises a lower externally threaded portion 50 affixed to the upper portion of the elongated hollow interconnecting element 36 and an upper internally threaded annular ring 52 configured to operatively mate with said lower externally threaded element 50 in combination with a substantially resilient annular ring 54 including a beveled periphery 56. In use, the upper tee element 38 is moved vertically relative to the elongated hollow interconnecting element 36 to desired position and then the upper internally threaded ring 52 is operatively mated with the lower externally threaded element 50 forcing resilient annular ring 54 to be pressed fitted between said lower element 50 and the external periphery of side wall of said upper tee element 38 to lock the elongated hollow interconnecting element 36 and the upper tee element 38 in position relative to each other. To limit the relative movement between the elongated hollow interconnecting element 36 and upper tee element 38 a limit means including an upper and lower stop 58 and 60 respectively are formed on the upper and lower portions of the upper tee element 38 to engage the upper portion of the elongated hollow interconnecting element 36 to prevent the elongated hollow interconnecting element 36 and the upper tee element 38 from becoming separated.

Figure 4:
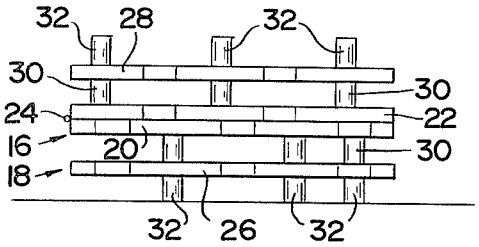
FIG. 4 is a side view of the batting tee collapsed for storage.

Normally the batting or hitting tee 10 is stored in the position as best shown in FIG. 4 In use, the upper and lower base member 16 and 18 are unfolded as best shown in FIGS. 2 and 3. In this position the batter then elects which hole or aperture 34*a* through 34*h* the lower tee element 40 is inserted therethrough. For example if the batter is right handed and standing in the normal position shown by A′ and wishes to practice the normal pitches he would swing from 34*a*, 34*c*, and 34*e*. That is, the inside pitch would be hit early, over the center of the plate and the outside pitch would be hit late. Correspondingly, the right hand batter standing in the rear portion of the box indicated as B′ would hit along the diagonal D. The left handed batter in position C′ would hit along the line of diagonal A while the left handed batter standing toward the rear of the box indicated as D′ would hit along the line B. The two-tiered base 12 permits enhanced stability of the overall batting tee 10 itself. In order to adjust the height of the ball contact by the batter, the set bolt or adjustment means 46 may be loosened permitting the vertical adjustment of the upper tee element 38 to move vertically in telescoping fashion relative to the elongated hollow interconnecting element 36. Once the beveled ball support element 44 has attained the proper height the adjustment means 46 is tightened. The batter may then place the ball on the top of the beveled ball support element 44 and commence practice swinging.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described,

What is claimed is:

1. A batting tee comprising a base and a substantially vertical adjustable tee member including an elongated hollow interconnecting element having an upper tee element telescopingly disposed therein, and a substantially flexible ball support member attached to the upper portion of said upper tee element and an adjustment means to selectively lock said upper tee element in a predetermined position relative to said elongated hollow interconnecting element and a plurality of apertures comprising a predetermined pattern formed in said base to selectively receive said elongated hollow interconnecting element to vary the ball hitting position relative to the batting tee, said predetermined pattern comprises at least two pair of substantially parallel diagonal rows of apertures wherein said two pairs of diagonal substantially parallel rows are inclined relative to each other to permit the batter to hit inside, over the center and outside pitcher from either of two positions according to the hitter's position in the batter's box on either side of said batting tee, said base comprises an upper base member comprising a first and second base element hingedly coupled together normally disposed in co-planar relationship to each other.

2. The batting tee of claim 1 further including a limit means, said limit means comprising a pair of stops formed at opposite ends of said upper tee element to limit the upper and lower movement of said upper tee element relative to said elongated hollow interconnecting element.

3. The batting tee of claim 1 wherein said adjustment means comprises an externally threaded portion extending upwardly from the upward portion of said elongated hollow interconnecting element and a annular ring including internally threaded portion to operatively mate with said externally threaded portion to lock the vertical position of said upper tee element relative to said elongated hollow interconnecting element.

4. The batting tee of claim 3 wherein said adjustment means further includes a resilient annular ring dimensioned to press fit between said threaded portions to engage the periphery of said upper tee element when said threaded portions are operatively coupled to lock said upper tee element in its vertical position relative to said elongated hollow interconnecting element.

5. The batting tee of claim 1 wherein said substantially flexible ball receiving element includes an upper enlarged portion to receive a ball thereon.

6. The batting tee of claim 1 wherein said base comprises an upper and lower base member each comprising a first and second base element normally disposed in co-planar relationship relative to each other.

7. The batting tee of claim 1 wherein said upper and lower base members are held in substantially parallel fixed spaced relationship relative to each other by first set of spacers disposed therebetween.

8. The batting tee of claim 7 further including a second set of spacers attached to the lower surface of said lower base member to support said batting tee above the ground when in use.

* * * * *